US007905328B2

(12) United States Patent
Windlin et al.

(10) Patent No.: US 7,905,328 B2
(45) Date of Patent: Mar. 15, 2011

(54) BRAKE DEVICE OF AN ELEVATOR CAR

(75) Inventors: Walter Windlin, Ennetmoos (CH); Stefan Hugel, Adligenswil (CH)

(73) Assignee: Inventio AG, Hergiswil (CH)

( * ) Notice: Subject to any disclaimer, the term of this patent is extended or adjusted under 35 U.S.C. 154(b) by 426 days.

(21) Appl. No.: 11/796,960

(22) Filed: Apr. 30, 2007

(65) Prior Publication Data

US 2007/0221453 A1 Sep. 27, 2007

(30) Foreign Application Priority Data

Apr. 28, 2006 (EP) ..... 06113302

(51) Int. Cl.
*B66B 5/06* (2006.01)
*B66B 1/34* (2006.01)

(52) U.S. Cl. ..... 187/286; 187/287; 187/393

(58) Field of Classification Search ..... 187/286, 187/393, 287, 302, 305
See application file for complete search history.

(56) References Cited

U.S. PATENT DOCUMENTS 2,511,697 A * 6/1950 Clift ..... 187/375
2,581,297 A * 1/1952 Rissler ..... 187/375
5,217,091 A * 6/1993 Shiina et al. ..... 187/351
5,299,661 A * 4/1994 Pramanik et al. ..... 187/373
6,318,506 B1 * 11/2001 Marte et al. ..... 187/373
6,619,435 B1 * 9/2003 Watzke et al. ..... 187/373

FOREIGN PATENT DOCUMENTS

JP 06 092568 4/1994
JP 06092568 A * 4/1994
JP 07 206309 8/1995
JP 2001 270666 10/2001

* cited by examiner

*Primary Examiner* — Evan H Langdon
(74) *Attorney, Agent, or Firm* — Wolff & Samson, PC

(57) ABSTRACT

A brake device of an elevator car with a brake unit that is mounted on the elevator car. The brake drive includes a flexible tension member that passes around two tension-members reversing-sheaves. One end of the tension members extends parallel to the travel path of the elevator car and is coupled to an actuating element of the brake unit, and thereby also to the elevator car, so that in normal operation the tension member moves synchronously with the elevator car. A blocking device, at least on overspeed of the elevator car, brakes the tension member, as a consequence of which the tension member, via the actuating element, activates the brake unit. A monitoring device detects failure of the coupling between the tension member and the elevator car.

14 Claims, 2 Drawing Sheets

BRAKE DEVICE OF AN ELEVATOR CAR

BACKGROUND OF THE INVENTION

The invention relates to a brake device of an elevator car that, at least on occurrence of an inadmissibly high speed of the elevator car, brakes the elevator car.

From JP 06092568 such a brake device is known, in which an overspeed governor with a rope sheave activates via an overspeed governor rope a brake unit on an elevator car. In the form of a closed loop, the overspeed governor rope passes at one end round the rope sheave of the overspeed governor that is arranged in the upper area of the car travel path, and at the other end round a rope reversing sheave that is present in the lower area of the car travel path. One end of the rope loop is coupled to an actuating element of the brake unit that is mounted on the elevator car, and therefore also to the elevator car. The lower rope reversing sheave is arranged vertically movable and loaded in downward direction by a weight, so that the rope loop is tensioned by the lower rope reversing sheave. A monitoring device with a detector monitors the position of this lower rope reversing sheave so as to influence the elevator control system in case of breakage, or excessive elongation, of the overspeed governor rope.

In the mentioned state of the art, breakage or excessive elongation of the overspeed governor rope is detected by a detector, and corresponding safety measures initiated if necessary. However, failure of the coupling between the overspeed governor rope and the elevator car during operation of the elevator is not detected by the monitoring device. This has the consequence that, on failure of the coupling, the elevator system remains in operation even though the brake device on the elevator car, that is of utmost importance for the safety of the passengers, is not functioning.

Possible causes of such failure of the coupling between the overspeed governor rope and the brake unit, and thereby also the elevator car are, for example, a fallen-out or fractured connecting bolt, a fractured actuating lever (actuating element) of the brake unit, or a broken actuating shaft via which the actuating lever is connected to the brake unit and thereby also the elevator car.

SUMMARY OF THE INVENTION

The object of the present invention is to provide a brake device of the type described above that does not possess the disadvantages of the device cited as the state of the art. In particular, a brake device for elevator cars shall be created in which, following failure of the coupling between the overspeed governor and the brake unit of the elevator car, the elevator system does not continue to remain in operation in an inadmissible condition of safety.

According to the invention, the object is fulfilled by means of a brake device for an elevator car, and an elevator system with the brake device, in which the brake device possesses the following characteristics:

- it contains at least one brake unit that is mounted on the elevator car and has an actuating element;
- it contains at least two tension-means reversing-sheaves, of which one is installed in the area of the upper end, and one in the area of the lower end, of the car travel path;
- it contains a flexible tension means that passes round the tension-means reversing sheave, at least one end of the tension means extending parallel to the travel path of the elevator car, being coupled to the actuating element of the brake unit and thereby to the elevator car, and in normal operation moving synchronously with the elevator car;
- it contains a blocking device that at least on overspeed of the elevator car brakes the tension means, as a result of which the tension means, via the actuating element, activates the brake unit; and
- it contains a monitoring device that detects failure of the coupling between the tension means and the elevator car.

The advantage achieved by the invention is mainly to be seen in that the operating safety of the elevator system is increased in that, on failure of the coupling (operating interaction) between the tension means and the elevator car, and thereby also the brake unit of the elevator car, an operating condition is avoided in which persons are transported with the elevator car even though the prescribed protection by the brake device is no longer capable of functioning.

According to a preferred embodiment of the invention, the tension means of the brake device forms a closed loop that passes round the tension-means reversing-sheaves. Both ends of the tension means are fastened to a coupling element that, at the same time, couples the tension means to the actuating element of the brake unit. The combination of the connection of the tension-means ends and the coupling into one single element has the advantages that two functions are fulfilled with the same component, that the weight is concentrated into one single component, and that thereby the greatest possible freedom for the arrangement of the tension-means reversing-sheave is achieved.

It is expedient for the coupling element to have a weight that, in the case of failure of the coupling between the tension means and the elevator car, is sufficient to set the tension means, along with the tension-means reversing-sheaves, in motion so that the coupling element falls.

A particularly simple and inexpensive embodiment of the invention is achieved through the monitoring device containing a detector that is mounted in the area of the lower tension-means reversing-sheave, that detects the coupling element should the coupling element, following failure of the coupling between the tension means and the brake unit, and thereby also the elevator car, fall to the level of the detector.

In a particularly preferred and functionally safe embodiment of the invention, the monitoring device contains a detector that is mounted on the elevator car and that, in normal operation, detects whether the coupling element is in its normal position relative to the elevator car, and signals failure of the coupling between the tension means and the elevator car as soon it no longer detects the coupling element.

In a particularly inexpensive embodiment of the brake device according to the invention, the detector is a switch with electrically conductive contacts that detects the presence of the coupling element with the aid of a mechanical sensing element.

A brake unit that is reliable and simple to install is obtained with a detector that contains a sensor that detects the presence of the coupling element touchlessly. For this purpose, it is advantageous for inductive sensors, capacitive sensors, or light sensors to be used.

It is expedient for the brake device according to the invention to be embodied in such manner that the detector of the monitoring device is in contact with an elevator control system which, in the case of a detected failure of the coupling between the tension means and the brake unit and thereby also the elevator car, interrupts operation of the elevator.

In a preferred embodiment of the invention, the elevator control system is conceived in such manner that, following detected failure of the coupling, it only interrupts operation of the elevator when the elevator car has reached a story, floor or landing. This avoids passengers remaining unnecessarily trapped in the elevator car and needing to be evacuated with third-party assistance.

Exemplary embodiments of the invention are explained below by reference to the attached drawings.

BRIEF DESCRIPTION OF THE DRAWINGS

Shown are in

DETAILED DESCRIPTION OF THE INVENTION

Figure 1:
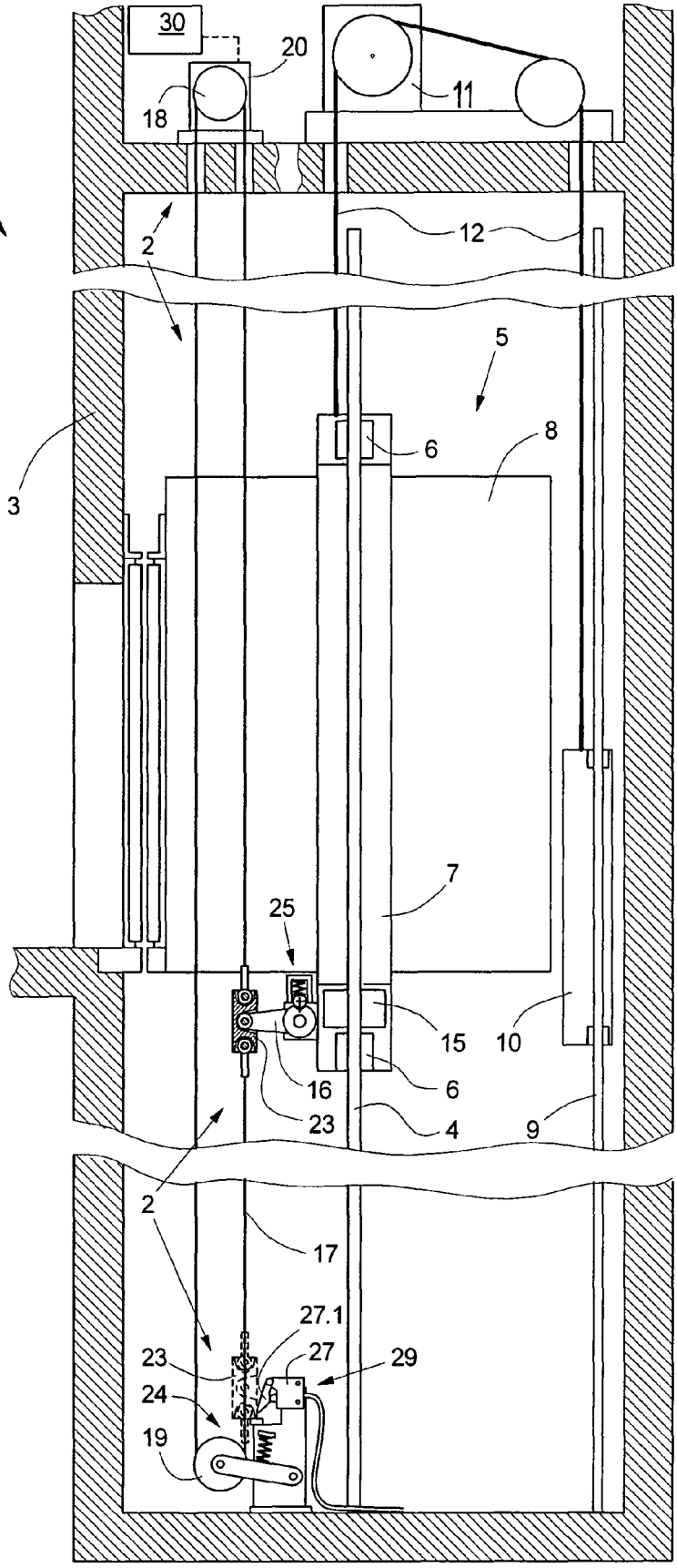
FIG. 1 a cross section through an elevator system according to the invention with a first embodiment of the brake device according to the invention.

FIG. 1 shows diagrammatically an elevator system 1 with a brake device 2 according to the invention. The elevator system 1 essentially comprises the following components:

- an elevator hoistway 3 with car guide rails 4 fastened therein;
- an elevator car 5 that is movable along the car guide rails 4, that has a car frame 7 that is guided by car guide shoes 6 on the car guide rails 4, and that has a car body 8 that is fastened in the car frame 7;
- a counterweight 10 that is guided on counterweight guide rails 9;
- a drive machine 11 that suspends and drives the elevator car 5 and the counterweight 10 via at least one flexible suspension means 12; and
- the brake device 2 with two brake units 15 that are fastened on the car frame 7 on both sides of the elevator car 5, an actuating lever 16 via which the brake units 15 are activated, a traveling flexible tension means 17 that is guided over an upper tension-means reversing-sheave 18 and a lower tension-means reversing-sheave 19, a blocking device 20 that can block movement of the tension means 17, a coupling element 23 that couples the tension means 17 with the actuating lever 16 of the brake unit 15, and a tension-means tensioning device 24 that guides the lower tension-means reversing-sheave 19 in a vertical direction and, via the reversing-sheave 19, tensions the tension means 17.

The brake device 2 and its manner of functioning are described in greater detail below.

The brake units 15 that are mounted on the elevator car 5 can be embodied as normal elevator safety brakes. In such safety brakes, via an actuating lever 16 and a system of mechanical levers that is not shown here, brake wedges or eccentric disks, for example, are brought into frictional contact with the car guide rails 4, whereupon, as a result of the relative movement and frictional effect between them and the car guide rails, the brake wedges or eccentric disks are brought into a position in which they themselves, or a brake body lying in between, are pressed so forcefully against the car guide rails 4 that the elevator car 5 is braked.

The brake units 15 can, for example, also contain hydraulically actuated brake pistons that press the brake plates against the car guide rails 4 and thereby brake the elevator car 5. Preferably, the actuating lever 16 thereby acts on valves that control application to the brake pistons of pressure fluid, and thereby the brake plates' are pressed against the guide rails.

Depending on the embodiment of the brake units, they can brake the travel of the elevator car in only one, or in both, direction(s) of travel.

An activation system activates the brake units 15 in case of inadmissibly high speed—hereinafter referred to as "overspeed"—or also in other situations that are detected by the elevator control system 30, that necessitate immediate and safe braking of the elevator car 5. The activation system contains the tension means 17 with two tension-means ends that extend parallel to the direction of travel of the elevator car 5. The tension means 17 passes over at least one upper tension-means reversing-sheave 18 and one lower tension-means reversing-sheave 19 and is fastened at both of its ends to the coupling element 23. This coupling element 23 is coupled to the actuating lever 16 of the brake unit 15 that is mounted on the elevator car 5, and that in normal operation is held disengageably in its normal position by a centering device 25. As a result thereof, in normal operation, one end of the traveling tension means 17 moves up and down synchronously with the elevator car 5. Present in the area of the upper tension-means reversing-sheave 18 is the blocking device 20 that, on detected overspeed of the tension means 17 and the elevator car 5, or on presence of a blocking signal generated by the elevator control system 30, blocks the tension means 17. The blocking is effected, depending on the embodiment, either by direct braking of the tension means 17 or by blocking of the upper tension-means reversing-sheave 18.

Usable as the tension means 17 for the brake device 2 are, for example, wire ropes, flat belts, toothed belts, or roller chains of all types.

On occurrence of inadmissibly high speed—hereinafter referred to as "overspeed"—or also of other situations detected by the elevator control system that necessitate immediate and safe braking of the elevator car 5, the tension means 17 is blocked by the blocking device 20, with the result that the coupling element 23 disengages the actuating lever 16 of the brake units 15 out of the position in which it is disengageably centered by the centering device 25, and thereby activates the brake units.

In case of failure as described above of the coupling between the coupling element 23 of the tension means 21 and the elevator car 5, and thereby also the brake units 15 that are mounted on the elevator car, the coupling element 23, along with the end of the tension means 17 that is fastened thereto, falls in the direction of the lower tension-means reversing-sheave 19. For this purpose, the coupling element 23 is executed sufficiently heavily that, despite frictional losses, its weight force can set the tension means 17 and the two tension-means reversing-sheaves 18, 19 into motion.

According to a first embodiment of the brake device 2 according to the invention, shortly before the coupling element 23 has reached its lowest possible position slightly above the lower tension-means reversing-sheave 19, it is detected by a detector 27 of a monitoring device 29. This situation is shown in the lowest part of FIG. 1, where the detector 27 is shown as an electric switch with a mechanical sensing element 27.1, and the fallen coupling element 23 is shown dotted. The detector 27 signals the presence of the coupling element 23 in its fallen position, and thereby failure of the coupling between the coupling element 23 of the tension means 17 and the elevator car 5, to the elevator control system 30, that brings the elevator system to a standstill preferably as soon as the elevator car has reached a floor.

Figure 2:
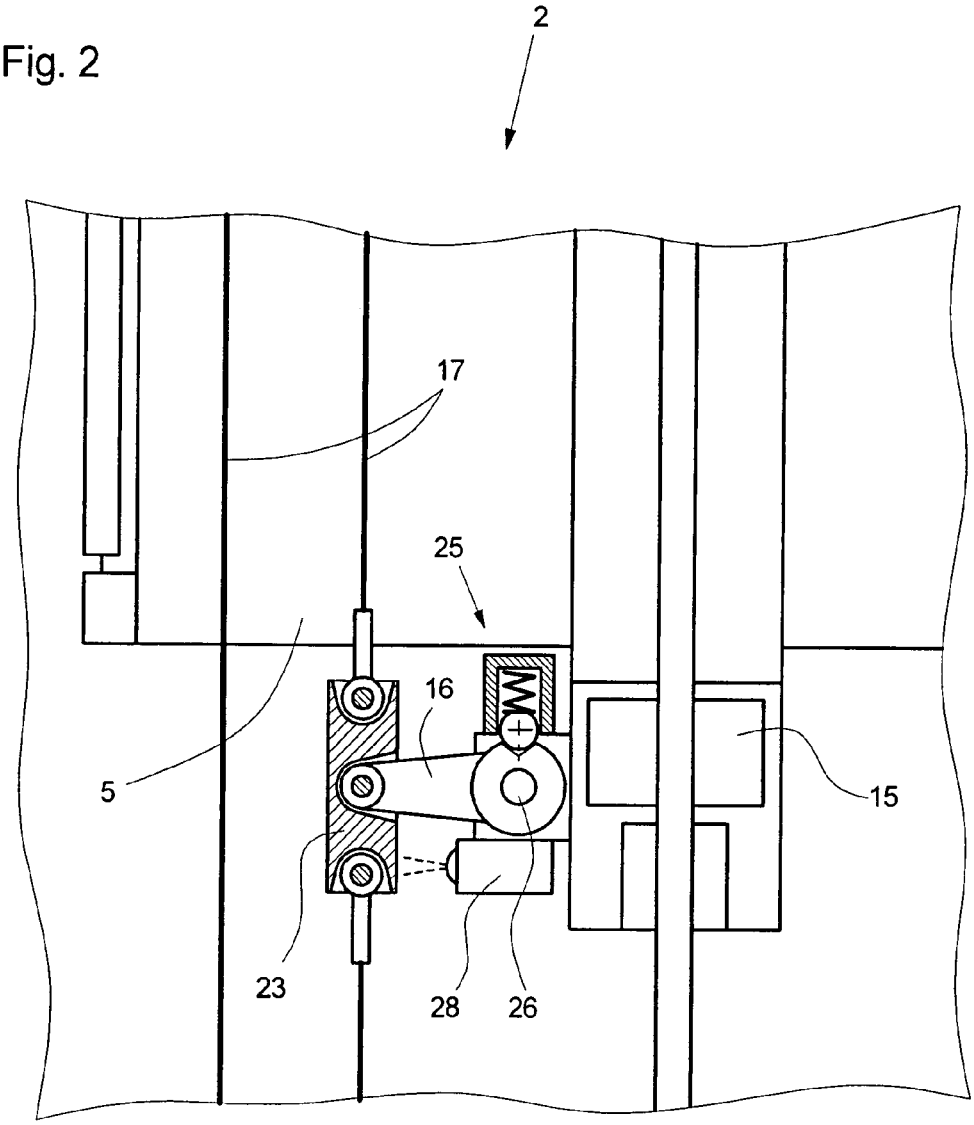
FIG. 2 an enlarged cutout of the elevator system according to FIG. 1 with a second embodiment of the brake device according to the invention.

FIG. 2 shows a second embodiment of the brake device 2 according to the invention, in which the position of the coupling element 23 relative to the elevator car 5 is monitored by a detector 28 that is connected to the car 5. Advantageously, a detector 28 is used that detects the coupling element touchlessly, i.e. that contains, for example, an inductively or capacitively acting sensor or an infrared light sensor. Following failure of the coupling between the coupling element 23 and the elevator car 5, as soon as the coupling element 23 moves out of the detecting area of the detector 28, also in this embodiment the detector 28 signals the failure of the coupling to the elevator control system 30, which brings the elevator system to a standstill preferably only when the elevator car has reached a story or floor. Advantageously, the service organization that is responsible for the elevator system is alarmed at the same time.

Particularly readily discernible in FIG. 2 is the centering device 25 already mentioned in association with FIG. 1, which, in normal operation of the elevator system, fixes the actuating lever 16 of the brake unit 15 that is mounted on the elevator car 5 disengageably in its normal position to ensure that in normal operation one end of the traveling tension means 17 moves up and down synchronously with the elevator car. Centering of the actuating lever 16 in its normal position is realized by a ball that is guided in a drilled hole being pressed by a compression spring into a notch of a disk that monolithically with the actuating lever 16 is swivelable about a common lever axle 26.

Although the present invention has been described in relation to particular embodiments thereof, many other variations and modifications and other uses will become apparent to those skilled in the art. It is preferred, therefore, that the present invention be limited but by the specific disclosure herein, but only by the appended claims.

The invention claimed is:

1. A brake device for an elevator car, comprising:

at least one brake unit that is mounted on the elevator car and has an actuating element;

at least two tension-means reversing-sheaves of which one is installed in an area of an upper end, and one in an area of a lower end, of a travel path of the car, respectively;

a flexible tension means that passes around the tension-means reversing-sheaves, the flexible tension means having two ends extending parallel to the travel path of the elevator car and being fastened to a coupling element that couples the tension means to the actuating element of the brake unit and thereby also to the elevator car, and in normal operation moving synchronously with the elevator car;

a blocking device operative to brake the tension means, at least on overspeed of the elevator car, so as to activate the brake unit via the actuating element; and a monitoring device that detects failure of the coupling between the tension means and the actuating element.

2. The brake device according to claim 1, wherein the tension means forms a closed loop that passes round the tension-means reversing-sheaves.

3. The brake device according to claim 2, wherein the coupling element has a weight that, in case of failure of the coupling between the tension means and the elevator car, is sufficient to set the tension means, along with the tension-means reversing-sheaves, into motion so that the coupling element falls.

4. The brake device according to claim 3, wherein the monitoring device includes a detector that is mounted in the area of the lower tension-means reversing-sheave and detects the coupling element when the coupling element falls to a level of the detector following failure of the coupling between the tension means and the brake unit and thereby also the elevator car.

5. The brake device according to claim 3, wherein the monitoring device includes a detector that is mounted on the elevator car, the detector being operative to detect, in normal operation, whether the coupling element is in a normal position relative to the elevator car, and to signal failure of the coupling between the tension means and the brake unit, and thereby also the elevator car, when the detector detects that the coupling element is no longer in the normal position.

6. The brake device according to claim 4, wherein the detector is a switch with electrically conductive contacts, and includes a mechanical sensing element that aids detection of presence of the coupling element.

7. The brake device according to claim 5, wherein the detector is a switch with electrically conductive contacts, and includes a mechanical sensing element that aids detection of presence of the coupling element.

8. The brake device according to claim 4, wherein the detector includes a sensor that touchlessly detects presence of the coupling element.

9. The brake device according to claim 5, wherein the detector includes a sensor that touchlessly detects presence of the coupling element.

10. The brake device according to claim 4, and further comprising an elevator control system in communication with the detector of the monitoring device, the elevator control system being operative to interrupt operation of the elevator system in case of a detected failure of the coupling between the tension means and the brake unit and thereby also the elevator car.

11. The brake device according to claim 5, and further comprising an elevator control system in communication with the detector of the monitoring device, the elevator control system being operative to interrupt operation of the elevator system in case of a detected failure of the coupling between the tension means and the brake unit and thereby also the elevator car.

12. The brake device according to claim 10, wherein the elevator control system is operative to interrupt operation of the elevator system as soon as the elevator car has reached a story.

13. The brake device according to claim 11, wherein the elevator control system is operative to interrupt operation of the elevator system as soon as the elevator car has reached a story.

14. An elevator system comprising:

an elevator car; and a brake device for the elevator car, comprising at least one brake unit that is mounted on the elevator car and has an actuating element; at least two tension-means reversing-sheaves of which one is installed in an area of an upper end, and one in an area of a lower end, of a travel path of the car respectively; a flexible tension means that passes around the tension-means reversing-sheaves, the flexible tension means having two ends extending parallel to the travel path of the elevator car and being fastened to a coupling element that couples the tension means to the actuating element of the brake unit and thereby also to the elevator car, and in normal operation moving synchronously with the elevator car; a blocking device operative to brake the tension means, at least on overspeed of the elevator car, so as to activate the brake unit via the actuating element; and a monitoring device that detects failure of the coupling between the tension means and the actuating element.

* * * * *